US005555946A

United States Patent [19]

Klatt

[11] Patent Number: 5,555,946

[45] Date of Patent: Sep. 17, 1996

[54] METHOD AND TOOL FOR USE IN COMMMENCING THE DRILLING OF A DEVIATED WELL

[76] Inventor: Darrell Klatt, Box 355, Caroline, Canada, T0M 0M0

[21] Appl. No.: 427,407

[22] Filed: Apr. 24, 1995

[51] Int. Cl.[6] ..... E21B 7/08; E21B 4/18

[52] U.S. Cl. ..... 175/061; 166/216; 175/45; 175/75; 175/325.5

[58] Field of Search ..... 175/61, 45, 75, 175/26, 27, 92, 97–99, 79, 81, 104, 107, 325.5; 166/216, 217

[56] References Cited

U.S. PATENT DOCUMENTS

| | | | |
|---|---|---|---|
| 2,500,267 | 3/1950 | Zublin | 175/75 |
| 2,734,721 | 2/1956 | Zublin | 175/76 |
| 3,023,821 | 3/1962 | Etherington | 175/81 |
| 3,888,319 | 6/1975 | Bourne et al. | 175/76 |
| 3,942,595 | 3/1976 | Sudnishnikov et al. | 175/99 |
| 4,060,141 | 11/1977 | Catterfeld | 175/94 |
| 4,108,256 | 8/1978 | Moore | 175/61 |
| 4,431,088 | 2/1984 | Dellinger et al. | 175/61 |
| 4,512,422 | 4/1985 | Knisley | 175/99 |
| 4,612,987 | 9/1986 | Cheek | 175/325.4 X |
| 4,697,651 | 10/1987 | Dellinger | 175/61 |
| 4,699,224 | 10/1987 | Burton | 175/61 |
| 4,854,399 | 8/1989 | Zijsling | 175/61 |
| 5,186,264 | 2/1993 | Chaffaut | 175/27 |
| 5,394,951 | 3/1995 | Pringle et al. | 175/45 |

*Primary Examiner*—Stephen J. Novosad
*Attorney, Agent, or Firm*—Rodman & Rodman

[57] ABSTRACT

A method and a tool for use in commencing the drilling of a deviated well from a gap in the casing of a cased wellbore using a non-rotary drill string while maintaining the desired orientation of the drill bit by minimizing the effects of reactive torque and axial loading on the drill string. The tool comprises a drill bit, a downhole motor, a tubular member connected between the downhole motor and the drill string, and an anchor assembly slidably mounted on the tubular member which is actuated by the tubular member to engage the casing during drilling of the well. The tubular member includes a setting section for actuating the anchor assembly, a freewheel section to facilitate orientation of the drill bit prior to drilling, and a working section for maintaining the orientation of the drill bit during drilling. The method of drilling using the tool includes the steps of positioning the tool in the wellbore, actuating the anchor assembly to engage the casing, orienting the drill bit in the desired direction by rotating the drill string, and then drilling the well by applying weight on the drill string to advance the drill bit while maintaining the orientation of the drill bit.

21 Claims, 8 Drawing Sheets

METHOD AND TOOL FOR USE IN COMMMENCING THE DRILLING OF A DEVIATED WELL

TECHNICAL FIELD

The present invention relates to a method and a tool for use in commencing the drilling of a deviated well in an existing cased wellbore using a non-rotary drill string.

BACKGROUND ART

Deviated (non-vertical) wells are often drilled using directional drilling techniques from a gap in the casing of an existing cased wellbore, which gap may comprise a window cut in the casing or a section cut from the casing. A non-rotating drill string having an attached drilling tool is run into the existing wellbore. The drilling tool typically includes a drill bit for drilling the deviated well, a downhole motor for rotating the drill bit without rotating the drill string, an orientating sub for orienting the drill bit and several joints of drill pipe. The drill string connects the drilling tool to the surface of the earth. To commence the drilling of the deviated well, the drill string is run into the existing wellbore until the drill bit is located at the gap in the casing. A survey tool is then run into the drilling tool and into the orientating sub. The drill string is then rotated until the desired bit direction is obtained. The survey tool is then removed. Once oriented, the drill string is lowered until the drill bit contacts the point in the wellbore from which drilling is to commence. The downhole motor is then operated to commence the drilling of the deviated well from the gap in the casing. Once the drilling of the deviated well has progressed for a distance from the gap sufficient to minimize magnetic interference caused by the casing string, typically 200–250 feet, a measure while drilling (MWD) system incorporating accurate but sensitive survey equipment or some other conventional directional drilling tool can be used to continue the drilling of the deviated well.

To drill the well, weight must be applied to the drill bit through the drill string. Typically, the more weight that is applied to the drill bit, the higher the penetration rate of the drill bit. This weight applies an axial load to the drill string, and also results in the generation of reactive torque by the downhole motor as the drill bit is forced against the end of the wellbore. The axial load can cause bending or buckling of the drill string, and the reactive torque can cause the drill string to twist. This bending and twisting of the drill string can in turn create difficulties in maintaining the desired orientation of the drill bit as drilling progresses, and the greater the weight applied to the drill bit, the more serious these difficulties become. The situation is aggravated where the weight applied to the drill bit fluctuates, since this adds a further element of uncertainty to trying to maintain the desired orientation of the drill bit.

To overcome the problems associated with reactive torque when commencing the drilling of a deviated well, and thus drill more accurately during the critical initial stages of directional drilling before the relatively sensitive MWD system can be used, the method of time drilling is often performed. With time drilling, as soon as the drill bit contacts the point from which drilling of the deviated well is to commence and the pump pressure in the downhole motor increases by a predetermined amount, no further weight is applied to the drill bit. The pump pressure is allowed to drop to its original pressure as the drill bit drills out from the commencement point. Once the pump pressure is back to its original pressure, the pressure is increased again by applying a small amount of weight to the drill bit. This cycle is repeated throughout drilling.

It has been found that time drilling is typically relatively costly and time-consuming. The amount of the weight on the bit and the resultant pump pressure must be carefully monitored and maintained within a relatively narrow range in order that orientation of the drill bit can be maintained relatively accurately during drilling. Further, while performing the time drilling method, the orientation of the drill bit is confirmed by the survey tool every approximately 6 to 9 feet drilled. As the survey tool is typically quite sensitive, it cannot be left in the orientating sub during drilling. Thus, drilling must cease every approximately 6 to 9 feet to allow the survey tool to be run back into the orientating sub. If the drill bit direction has not changed, drilling is resumed. If the direction has changed, the drill bit must be reoriented. Thus, again, the entire time drilling process can be very time-consuming.

As well as time drilling, other methods have been developed to assist in maintaining the orientation of the drill bit during drilling. For example, U.S. Pat. No. 4,697,651 issued Oct. 6, 1987 to Dellinger is directed at a method for carrying out directional drilling with a rotary drilling tool by imparting both rotation and a rapid dynamic movement downward to the tool so that the drill bit impacts the end of the wellbore. A drilling stroke is then produced by allowing the tool to move from a contracted position to an extended position and an MWD system is used to monitor the orientation of the drill bit between strokes. In this manner, weight continues to be applied to the drill bit during the drilling stroke. Further, the tool includes spiral bladed stabilizers to effect proper orientation of the drill bit prior to each drilling stroke as the drill tool is raised to move the drill bit out of contact with the end of the wellbore.

As indicated, Dellinger involves a relatively complex series of steps. As well, the weight on the bit may be limited by the extension of the tool from the contracted position to the extended position and the required movement of the drill string between each drilling stroke may cause difficulties with maintaining the orientation of the drill bit. Finally, Dellinger does not appear to contemplate the commencement of drilling of a deviated well from a fully cased existing wellbore.

There is therefore a need in the industry for a drilling tool and method for use in commencing the drilling of a deviated well from an existing cased wellbore which maintains the desired orientation of the drill bit by minimizing the effects of reactive torque and axial loading on the drill string, while allowing a relatively more consistent weight, and a relatively greater weight, to be applied to the drill bit as compared to previously known tools and methods.

DISCLOSURE OF INVENTION

The present invention relates to both a method and a tool for use in commencing the drilling of a deviated well from a gap in the casing of a cased wellbore using a non-rotary drill string, while maintaining the desired orientation of the drill bit by minimizing the effects of reactive torque and axial loading on the drill string.

In one aspect of the invention, the invention is a tool for connection to a non-rotary drill string for use in commencing the drilling of a deviated well from a point in a wellbore, the wellbore including a casing within it and the point defining a gap in the casing, the tool comprising:

(a) a drill bit for drilling the well;

(b) a downhole motor operatively connected to the drill bit for rotating the drill bit to drill the well;

(c) a tubular member connected between the downhole motor and the drill string such that rotation of the drill string will cause rotation of the tubular member and the drill bit;

(d) an anchor assembly slidably mounted about the tubular member such that the tubular member is movable longitudinally relative to the anchor assembly, which anchor assembly is actuated by the rotation of the drill string, for releasably engaging the casing and for maintaining the orientation of the drill bit during drilling of the well;

(e) means for actuating the anchor assembly to selectively set the anchor assembly in engagement with the casing upon the rotation of the drill string in a first direction and to selectively unset the anchor assembly from engagement with the casing upon the rotation of the drill string in a second direction;

(f) means for facilitating the orientation of the drill bit prior to drilling by rotation of the drill string so that the drill bit is oriented in a desired direction; and (g) means for maintaining the orientation of the drill bit in the desired direction during drilling of the well when the anchor assembly is set by inhibiting the rotation of the drill string in the first direction caused by reactive torque generated in the drill string by the rotation of the drill bit in a second direction opposite to the first direction.

The actuating means, the facilitating means and the maintaining means are preferably all associated with the tubular member, and the actuating means and the maintaining means are preferably comprised of the tubular member having an outer surface complementary to an inner surface of the anchor assembly for engagement therewith. The complementary surfaces may be splines or the complementary surfaces may be octagonal in shape. The actuating means and the maintaining means may be the same means, or they may be different means.

The tubular member may have a setting section which serves as the actuating means, a working section which serves as the maintaining means, and a freewheel section which serves as the facilitating means. The setting section and the working section may comprise the same section of the tubular member, but preferably the setting section is adjacent the lower end of the tubular member, the working section is adjacent the upper end of the tubular member, and the freewheel section is between the setting section and the working section. Preferably, the working section is about 36 feet long.

The anchor assembly preferably comprises a sleeve slidably mounted on the tubular member, an upper wedge and a lower wedge movably mounted about the sleeve, one or more anchors mounted about the sleeve, biased towards the sleeve by resilient means and associated with the wedges, and means for selectively moving the wedges together and apart to set and unset the anchors. The moving means are preferably comprised of threads on the inner surfaces of the wedges and compatible threads on the outer surface of the sleeve.

The tool preferably also comprises a housing mounted about the anchor assembly and defining an opening for each anchor, including means for inhibiting the rotation of the housing upon rotation of the sleeve, and including means associated with the housing for inhibiting the rotation of the anchors upon rotation of the sleeve.

The tool may also comprise securing means which releasably secure the anchor assembly to the tubular member to prevent longitudinal movement between the anchor assembly and the tubular member. These securing means may comprise a latch member connected to the lower end of the sleeve, the latch member having a latch shoulder, and at least one spring extending from the lower end of the tubular member, the spring having a spring shoulder and being biased such that when the lower end of the sleeve and the lower end of the tubular member are brought together, the latch shoulder and the spring shoulder will be in biased contact with each other.

The tool preferably also comprises means for determining the orientation of the drill bit, which means may be a survey tool which can be removably positioned in an orientating sub which is connected adjacent the downhole motor.

The tool may also comprise a length of drill pipe which is connected between the downhole motor and the tubular member such that rotation of the tubular member will cause rotation of the length of drill pipe and the drill bit. Preferably, the combined length of the tubular member and the drill pipe is such that the tool is capable of maintaining the orientation of the drill bit to within about 10 degrees of the desired direction as the working section moves longitudinally through the anchor assembly. This combined length of the drill pipe and working section is preferably less than about 130 feet.

In a second aspect of the invention, the invention is a method for use in commencing the drilling of a deviated well from a point in a wellbore, the wellbore including a casing within it and the point defining a gap in the casing, using a nonrotary drill string having an attached drilling tool comprised of a drill bit for drilling the well, a downhole motor operatively connected to the drill bit for rotating the drill bit to drill the well, a tubular member connected between the downhole motor and the drill string and an anchor assembly, slidably mounted on and selectively actuated by the rotation of the tubular member, for releasably engaging the casing, the method comprising the steps of:

(a) positioning the drill string and the drilling tool in the wellbore;

(b) first engaging the tubular member with the anchor assembly such that rotation of the tubular member actuates the anchor assembly;

(c) setting the anchor assembly by rotating the drill string in a first direction in order that the drill string rotates the tubular member which actuates the anchor assembly such that the anchor assembly firmly engages the casing;

(d) disengaging the tubular member from the anchor assembly such that the tubular member may freely rotate within the anchor assembly;

(e) orienting the drill bit in a desired direction by rotating the drill string in order that the tubular member rotates within the anchor assembly to position the drill bit in the desired direction;

(f) second engaging the tubular member with the anchor assembly to support the tubular member and to inhibit further rotation of the tubular member in the first direction and thus maintain the desired direction of the drill bit while allowing the tubular member to move longitudinally relative to the anchor assembly; and (g) drilling the well by moving the drill bit to the point and operating the downhole motor to rotate the drill bit in a second direction opposite to the first direction such that any reactive torque generated by the downhole motor urges the drill string and the tubular member to rotate in the first direction, while applying weight on the drill bit through the drill string in order that the tubular member moves longitudinally relative to the anchor assembly as the drill bit advances to drill the well from the point, so that the tubular member moves longitudinally relative to the anchor assembly from a start position to an end position in which the tubular member can no longer move longitudinally relative to the anchor assembly.

The method may comprise the additional steps of unsetting the anchor assembly by rotating the drill string in a second direction, repositioning the drill string and the drilling tool in the wellbore, and then repeating steps (a) through (g). The method may also comprise the additional steps of securing the tubular member to the anchor assembly during positioning and repositioning of the drill string and the drilling tool in the wellbore. The method may also comprise the additional steps of interrupting step (g) before the end position is reached, performing steps (d) through (f) again to confirm the orientation of the drill bit, and then resuming step (g).

Where the tubular member comprises a setting section, a working section and a freewheel section, step (b) of the method comprises moving the tubular member longitudinally relative to the anchor assembly so that the setting section engages the anchor assembly, step (d) of the method comprises moving the tubular member longitudinally relative to the anchor assembly so that the freewheel section is located within the anchor assembly, and step (f) of the method comprises moving the tubular member longitudinally relative to the anchor assembly so that the working section engages the anchor assembly. Step (g) of the method may then be comprised of moving the working section through the anchor assembly from the start position at a first end of the working section to the end position at a second end of the working section.

The method may also comprise the steps prior to step (e), of lowering a survey tool into the drilling tool and determining the orientation of the drill bit within the survey tool, following which the survey tool is preferably removed from the drilling tool following step (e).

The method may also comprise the step of confirming the setting of the anchor assembly after step (c) by applying a longitudinal force to the drill string. Finally, step (a) of the method may be comprised of moving the drill string through the wellbore until the drill bit contacts the point in the wellbore from which the well is to be drilled, and then moving the drill bit a distance away from the point such that the tubular member can be moved longitudinally through the anchor assembly when the anchor assembly is set without contacting the drill bit against the point until the working section of the tubular member is located within the anchor assembly.

BRIEF DESCRIPTION OF DRAWINGS

Embodiments of the invention will now be described with reference to the accompanying drawings, in which.

BEST MODE OF CARRYING OUT INVENTION

The preferred embodiment of the invention is hereafter described in relation to its application in drilling deviated wells in a cased wellbore where the diameter of the casing is approximately 5½ inches. Modifications to the preferred embodiment may be necessary where the casing in the wellbore has a diameter other than about 5½ inches.

Figure 1:
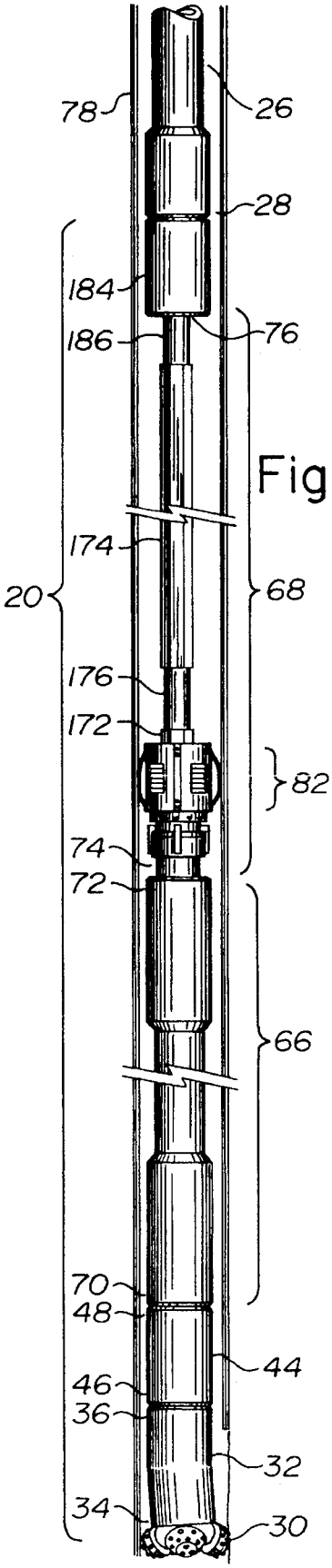
FIG. 1 is a pictorial side view of a drilling tool of the invention connected to a drill string and located within an existing cased wellbore, the drilling tool including a drill bit, a downhole motor, an orientating sub, a tubular member and an anchor assembly.

Referring to FIG. 1, the invention in its apparatus form is comprised of a tool (20) for drilling a deviated well (22) in an existing wellbore (24) containing a casing (78). The tool (20) is connected to a non-rotary drill string (26) at an end (28) beneath the surface of the earth. The other end (not shown) of the drill string (26) runs to the surface and the drill string (26) is supported in the wellbore (24) at the surface by conventional known means. The drill string (26) is non-rotary in that rotation of the drill string (26) is not required in order to perform the drilling operation. In other words, a drill bit (30) forming part of the tool (20) attached to the drill string (26) rotates independently to drill the well without rotation of the drill string (26). The operation of the drill bit (30) is described further below.

The tool (20) is comprised of a drill bit (30) for drilling the deviated well (22). The drill bit (30) may be any type of conventionally known drill bit. The drill bit (30) is operatively connected to a downhole motor (32) having a lower end (34) and an upper end (36). The drill bit (30) is connected to the lower end (34) of the downhole motor (32). Thus operation of the downhole motor (32) causes the drill bit (30) to rotate while the remainder of the tool (20) and the attached drill string (26) remain relatively stationary. In the preferred embodiment, the drill bit (30) rotates to the right or clockwise in order to drill the well.

Any type of downhole motor (32) may be used such as a downhole motor (32) powered by mud, water, air, nitrogen or any combination thereof. However, in the preferred embodiment of the tool (20), a conventional mud motor is used. The lower end (34) of the downhole motor (32) is offset at an angle (38) relative to the upper end (36) of the downhole motor (32) in order that the drill bit (30) is directed at an angle to the existing wellbore (24) to drill the deviated well (22). The offset angle (38) of the downhole motor (32) may be any degree, however, a two degree or greater offset is preferable. The surface of the downhole motor (32) including the vertex of the offset angle (38) defines the front (40) of the downhole motor (32). Thus during drilling, the front (40) of the downhole motor (32) faces in the direction to be drilled. Further, the downhole motor (32) includes a scribe line (42) centred on the front (40) of the downhole motor (32) extending from the lower end (34) to the upper end (36) of the downhole motor (32).

Figure 2:
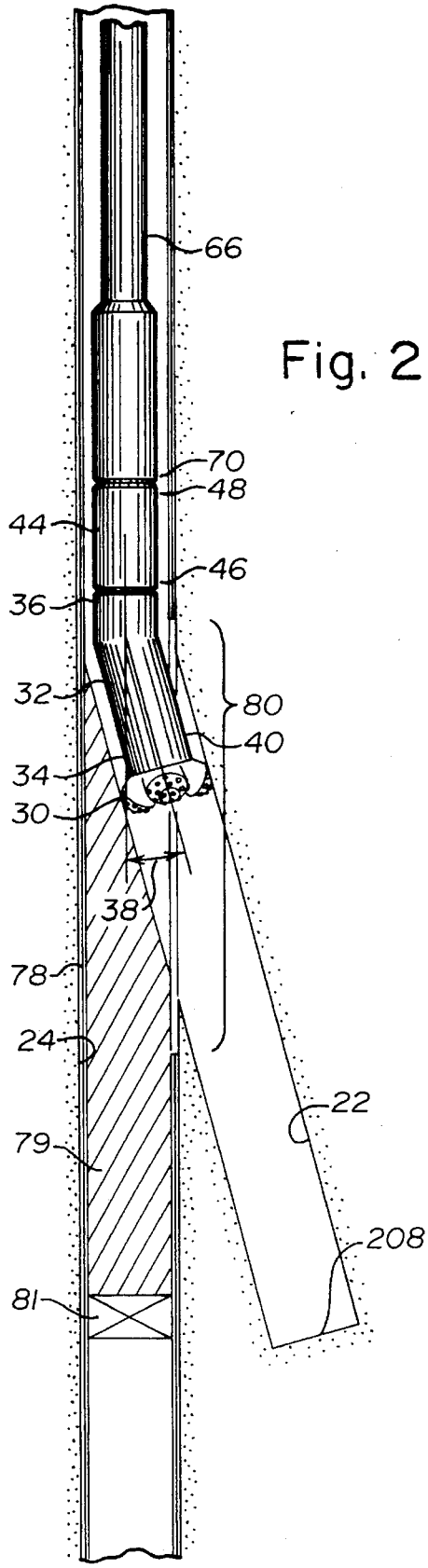
FIG. 2 is a pictorial side view of the lower end of the drilling tool of FIG. 1 positioned at a window cut in the casing of an existing wellbore.
Figure 9:
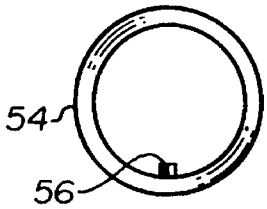
FIG. 9 is a longitudinal end view of the keyway sleeve of the drilling tool of FIG. 1.
Figure 7:
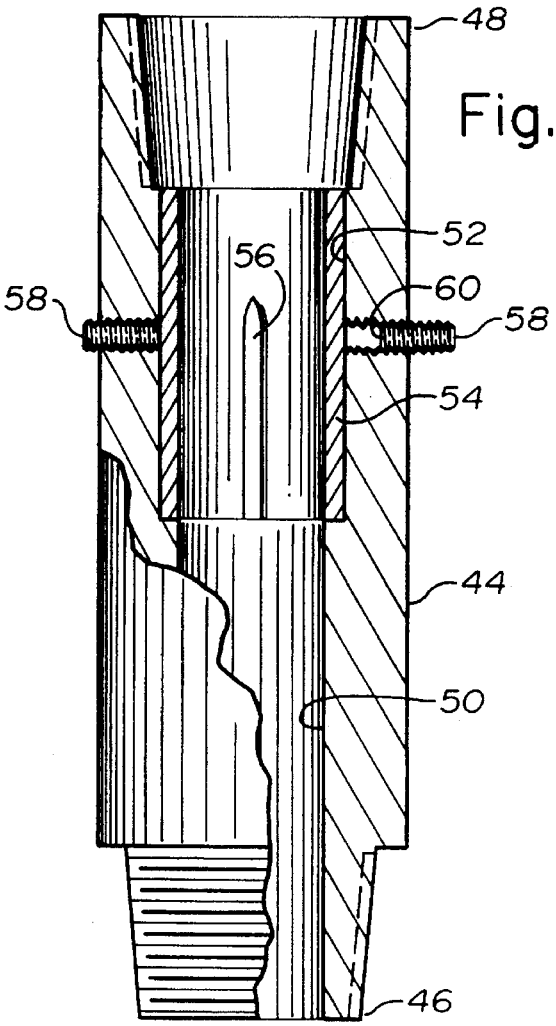
FIG. 7 is a partial cutaway side view of the orientating sub of the drilling tool of FIG. 1.
Figure 15:
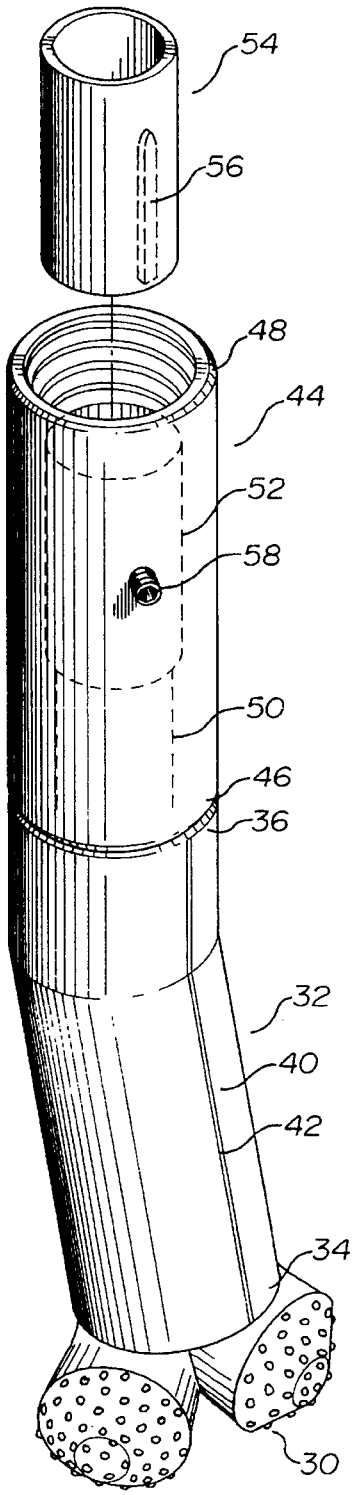
FIG. 15 is a pictorial partially exploded view of the orientating sub, the downhole motor and the drill bit of the drilling tool of FIG. 1.

Referring to FIGS. 7, 9 and 15, the tool (20) is further comprised of an orientating sub (44) having a lower end (46) and an upper end (48) connected to the downhole motor (32). Specifically, the lower end (46) of the orientating sub (44) is connected to the upper end (36) of the downhole motor (32) by a threaded connection. As shown in FIG. 2, the orientating sub (44) is tubular in shape such that a bore (50) passes from the lower end (46) to the upper end (48). The bore (50) includes an enlargement therein referred to as a keyway sleeve holder (52). A tubular keyway sleeve (54) is located within the keyway sleeve holder (52) such that the keyway sleeve (54) may freely rotate within the keyway sleeve holder (52). The keyway sleeve (54) includes a keyway (56), being an elongated convex protrusion on the inner surface of the keyway sleeve (54) into the bore of the keyway sleeve (54) oriented parallel to the longitudinal axis of the keyway sleeve (54).

The keyway sleeve (54) is rotated within the keyway sleeve holder (52) until the keyway (56) is lined up with the scribe line (42) on the downhole motor (32). Once the keyway (56) is aligned along the same axis as the scribe line (42), at least one set screw (58) and preferably two, are tightened to lock the position of the keyway sleeve (54) in the keyway sleeve holder (52). Each set screw (58) extends from an outer surface of the orientating sub (44) to an end (60) within the bore (50) of the orientating sub (44) at the location of the keyway sleeve holder (52) in order that the end (60) of the set screw (58) may engage the keyway sleeve (54) when tightened to lock the keyway sleeve (54) in position.

Figure 8:
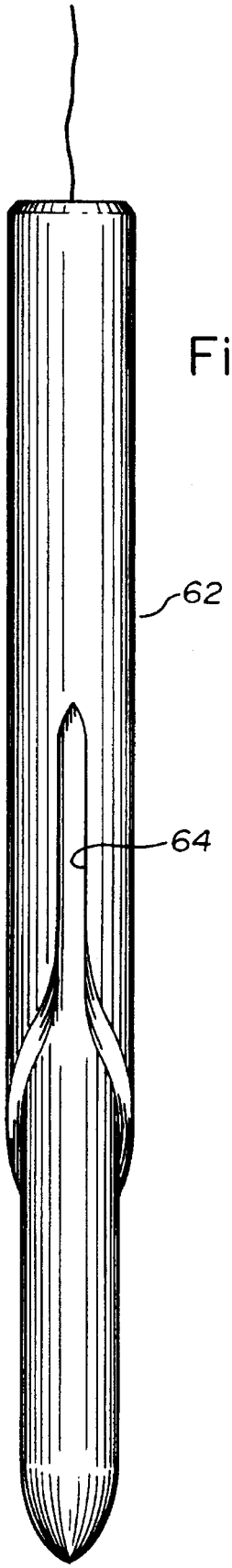
FIG. 8 is a pictorial side view of a survey tool for use with the drilling tool of FIG. 1.

During performance of the drilling method described below, a survey tool (62) such as is depicted in FIG. 8 is run on a wire line inside the drill string (26) and into the tool (20) to be positioned temporarily within the orientating sub (44). The survey tool (62) is used to survey the orientation of the drill bit (30). Preferably a gyro survey tool is used. An outer surface of the survey tool (62) includes an orientation slot (64) being an elongated groove or recess in the outer surface of the survey tool (62) oriented parallel to the longitudinal axis of the survey tool (62). When positioned in the orientating sub (44), the keyway (56) of the downhole motor (32) is received within the orientation slot (64) in order to fix the position of the survey tool (62) within the orientating sub (44). The survey tool (62) is removed from the orientating sub (44) prior to the commencement of drilling.

In its preferred embodiment, the tool (20) is further comprised of a drill pipe (66) and a tubular member (68). A lower end (70) of the drill pipe (66) is connected by a threaded connection to the upper end (48) of the orientating sub (44). An upper end (72) of the drill pipe (66) is connected by a threaded connection to a lower end (74) of the tubular member (68). An upper end (76) of the tubular member (68) is connected by a threaded connection to the end (28) of the drill string (26), so that rotation of the drill string (26) will cause rotation of the tubular member (68), the drill pipe (66), and the drill bit (30).

Referring to FIG. 2, the wellbore (24) includes a casing (78). To drill the deviated well (22), a gap such as a window (80) is cut in the casing (78) after setting a whipstock (79) in the wellbore (24) directly above a bridge plug (81).

The drill pipe (66) is comprised of at least one joint of drill pipe. The number of joints of drill pipe (66) used depends upon the desired distance to be drilled through the window (80) in the casing (78) of the existing wellbore (24) using the tool (20). In the preferred embodiment, three joints of drill pipe (66) are used which provides a total length of the drill pipe (66) of approximately 90 feet. If the length of the drill pipe (66) is approximately 90 feet, the buckling effects of weight on the drill bit and the effects of reactive torque generated by the downhole motor (32) during drilling can be expected to be minimal. Although a length of approximately 90 feet is preferred, any length of drill pipe (66) may be used. However, the greater the length of the drill pipe (66), the greater the unsupported length of the tool (20) between the drill bit (30) and the anchor assembly (82) and the more difficult it will be to predict the effects of weight and reactive torque on the orientation of the drill bit (30). Therefore, the length of the drill pipe (66) should be chosen to suit the particular drilling operation. If the direction or orientation of the drill bit (30) is critical, the length should be minimized. If the direction is less critical and a larger distance from the casing (78) is required, then the length can be increased. In most circumstances, a margin of error of up to about 10° in the final orientation of the drill bit (30) using the tool (20) relative to the desired orientation of the drill bit (30) will be acceptable, with the result that the length of drill pipe (66) may optionally be chosen so as to yield such a margin of error. It should, however, be noted that the effects of weight and reactive torque on the orientation of the drill bit (30) will vary depending upon the type and size of the drill string (26). For instance, a drill string (26) having a smaller diameter or having greater flexibility will be more prone to buckling under weight and will typically result in the generation of greater twisting of the drill string (26) due to reactive torque.

Figure 5:
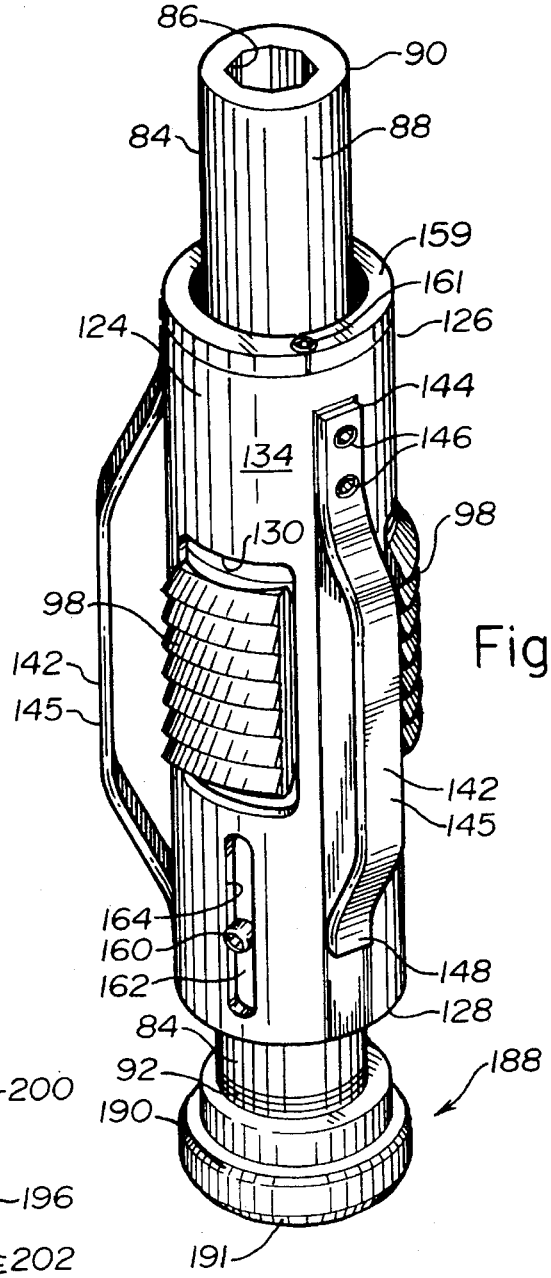
FIG. 5 is a pictorial view of the anchor assembly of the drilling tool of FIG. 1.
Figure 6:
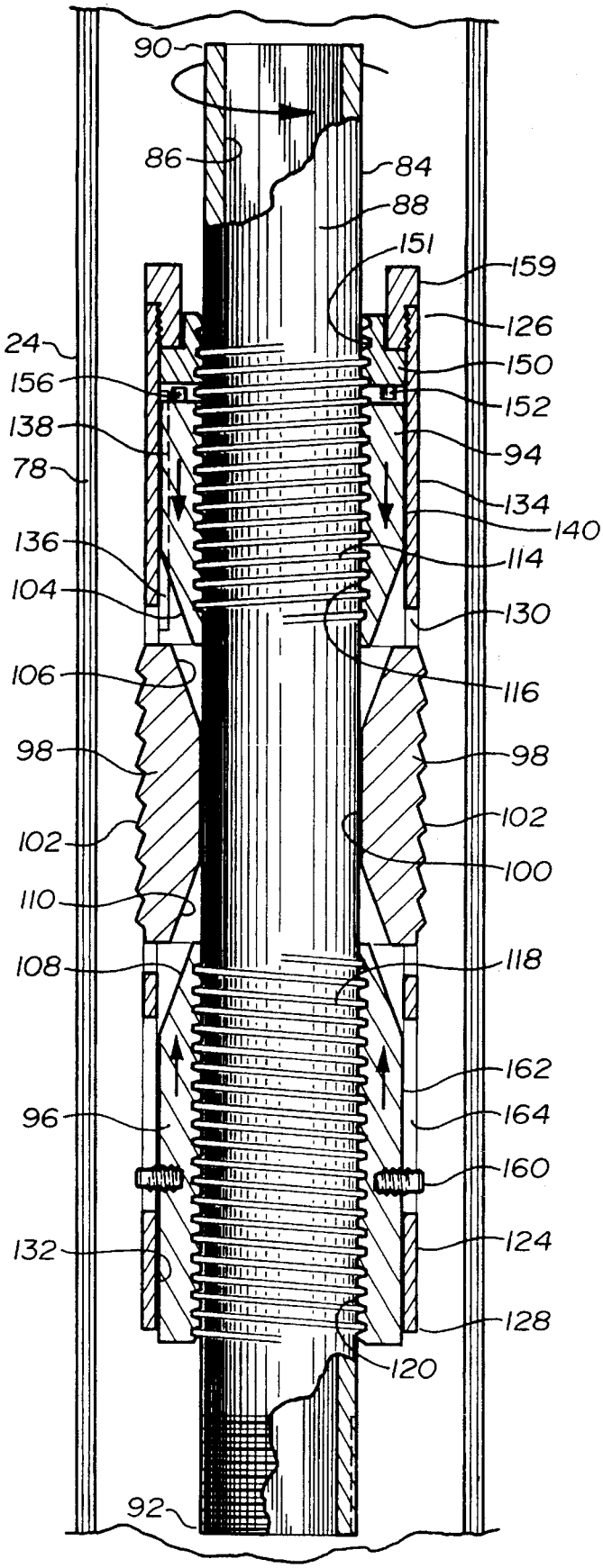
FIG. 6 is a sectional side view of the anchor assembly of the drilling tool of FIG. 1.

Finally, and referring to FIGS. 5 and 6, the tool (20) is further comprised of an anchor assembly (82) actuated by the rotation of the drill string (26) and the tubular member (68), which anchor assembly (82) releasably engages the casing (78) to support the tubular member (68) and inhibit the rotation of the drill string (26) and the tubular member (68) due to reactive torque. The anchor assembly (82) is slidably mounted about the tubular member (68) so that the tubular member (68) is movable longitudinally within the anchor assembly (82) when the anchor assembly (82) is engaged with the casing (78).

The anchor assembly (82) may comprise a conventional tubing anchor assembly which has been modified or adapted for use in conjunction with the tubular member (68). Referring to FIGS. 5 and 6, the anchor assembly (82) of the preferred embodiment is comprised of a tubular sleeve (84) having an inner surface (86) and an outer surface (88) and having an upper end (90) and a lower end (92). The inner surface (86) of the sleeve (84) selectively engages the tubular member (68) in the manner described below. When the inner surface (86) of the sleeve (84) engages the tubular member (68), rotation of the drill string (26) rotates the tubular member (68) which causes the sleeve (84) to rotate in the same direction. In addition, when the anchor assembly (82) is engaged with the casing (78), further rotation of the drill string (26) and the tubular member (68) will be inhibited in the manner as described below.

Figure 12:
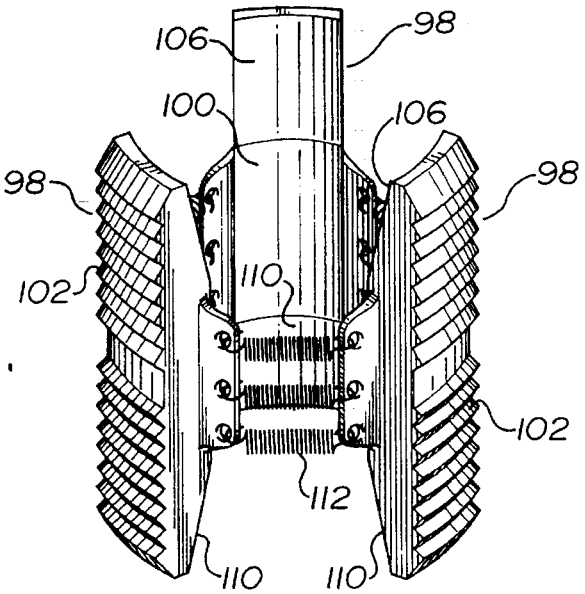
FIG. 12 is a pictorial view of the anchors and springs of the anchor assembly of the drilling tool of FIG. 1.
Figure 13:
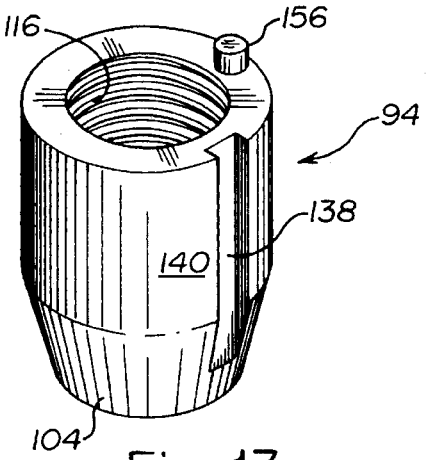
FIG. 13 is a pictorial view of the upper wedge of the anchor assembly of the drilling tool of FIG. 1.
Figure 14:
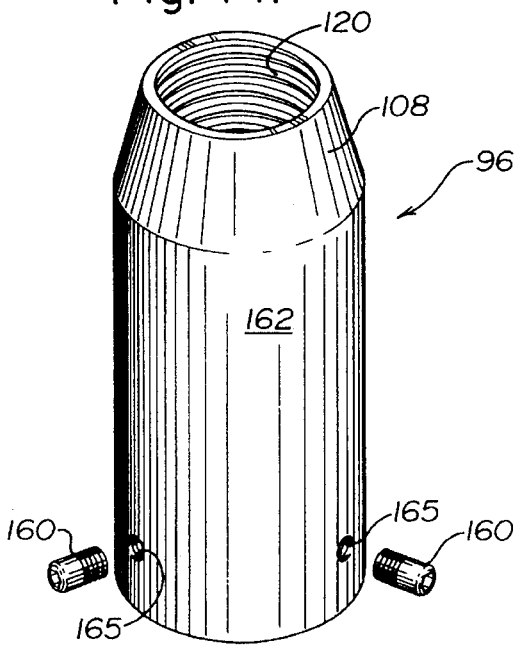
FIG. 14 is a pictorial view of the lower wedge of the anchor assembly of the drilling tool of FIG. 1.

Referring to FIGS. 13 and 14, the anchor assembly (82) further includes a tubular upper wedge (94) and a tubular lower wedge (96) movably mounted about the sleeve (84). The upper wedge (94) is movably mounted about the upper end (90) of the sleeve (84) and the lower wedge (96) is movably mounted about the lower end (92) of the sleeve (84). Further, and referring to FIG. 12, at least one anchor (98), and preferably three anchors, are also mounted about the sleeve (84) between the upper wedge (94) and the lower wedge (96). Each of the anchors (98) has an inner surface (100) adjacent the outer surface (88) of the sleeve (84) and an outer surface (102) for engaging the casing (78). The anchors (98) are mounted about the sleeve (84) in a manner such that the anchors (98) are movable laterally away from the sleeve (84) so that the inner surface (100) of the anchors (98) is a distance away from the outer surface (88) of the sleeve (84) and the outer surface (102) of the anchors (98) engages the casing (78). In the preferred embodiment, the three anchors (98) are spaced equally about the sleeve (84) so that upon the engagement of the anchors (98) with the casing (78), the sleeve (84) is substantially centred within the wellbore (24).

Referring to FIG. 12, resilient means are associated with the anchors (98) for urging the inner surface (100) of the anchors (98) in close relationship with the outer surface (88) of the sleeve (84). In the preferred embodiment, the resilient means are a plurality of springs (112) interconnecting the anchors (98).

The upper wedge (94) has a first wedge surface (104) facing a complementary first wedge surface (106)located on each of the anchors (98). Similarly, the lower wedge (96) has a second wedge surface (108) facing a complementary second wedge surface (110)located on each of the anchors (98). The anchor assembly (82) further includes means for selectively moving the upper wedge (94) towards or away from the lower wedge (96) upon the rotation of the sleeve (84).

In the preferred embodiment, rotation of the sleeve (84) in a first direction, being to the left or counterclockwise, results in the moving means moving the upper wedge (94) and the lower wedge (96) closer together until the first wedge surface (104) on the upper wedge (94) contacts the first wedge surface (106) on the anchors (98) and the second wedge surface (108) on the lower wedge (96) contacts the second wedge surface (110) on the anchors (98). Once contact occurs, further rotation of the sleeve (84) in the first direction causes the upper wedge (94) and the lower wedge (96) to move closer together forcing the anchors (98) to move laterally away from the sleeve (84) into engagement with the casing (78) and thus set the anchors (98) and the anchor assembly (82). Once the anchors (98) are in firm engagement with the casing (78), further rotation of the sleeve (84) in the first direction is prevented. Accordingly, rotation of the tubular member (68) and the drill string (26) in the first direction is inhibited when the tubular member (68) is engaged with the anchor assembly (82). As the drill bit (30) rotates to the right or clockwise during drilling, the reactive torque tends to urge the drill string (26) to rotate in the first direction to the left. As a result, once the anchors (98) are set, rotation of the drill string (26) and the tubular member (68) due to the effects of reactive torque is inhibited when the tubular member (68) is engaged with the anchor assembly (82).

Rotation of the sleeve (84) in the second direction, opposite to the first direction, being to the right or clockwise, results in the moving means moving the upper wedge (94) and the lower wedge (96) apart, thus unsetting the anchors (98) and the anchor assembly (82) by disengaging the anchors (98) from the casing (78). The anchors (98) will be urged to move laterally towards the sleeve (84) by the springs (112) as the sleeve (84) is rotated in the second direction until the inner surface (100) of the anchors (98) comes into contact with the outer surface (88) of the sleeve (84).

In the preferred embodiment, the means for moving the upper wedge (94) and the lower wedge (96) are comprised of a threaded connection between top threads (114) on the outer surface (88) of the upper end (90) of the sleeve (84) and threads on an inner surface (116) of the upper wedge (94) and a threaded connection between bottom threads (118) on the outer surface (88) of the lower end (92) of the sleeve (84) and threads on an inner surface (120) of the lower wedge (96). The moving means are further comprised of means for preventing the rotation of the upper and lower wedges (94, 96) upon the rotation of the sleeve (84) in order that the wedges (94, 96) move along the outer surface (88) of the sleeve (84). The means for preventing rotation of the wedges (94, 96) are described further below. The top threads (114) are righthand threads and the bottom threads (118) are lefthand threads. As a result, rotation of the sleeve (84) in the first direction moves the wedges (94, 96) together and rotation of the sleeve (84) in the second direction moves the wedges (94, 96) apart.

Optionally, the lower wedge (96) may comprise an outer portion for contacting the anchors (98) and an inner portion for actuation by the moving means. These two portions of the lower wedge (96) may then be connected by one or more shear pins so that if the anchor assembly (82) becomes stuck in the wellbore (24) in the set position, the lower wedge (96) can be collapsed by exerting either a longitudinal or rotational force on the anchor assembly (82) to shear the shear pins.

Referring to FIGS. 5 and 6, tubular housing (124) is mounted about the sleeve (84) and contains the upper wedge (94) and the lower wedge (96) therein. The housing (124) has an upper end (126) adjacent the upper end (90) of the sleeve (84) and a lower end (128) adjacent the lower end (92) of the sleeve (84). Approximately midway between the upper end (126) and the lower end (128), the housing (124) defines a first opening (130) for each of the anchors (98). Thus, when the anchors (98) are disengaged, and thus unset, the anchors (98) are contained within the housing (124). However, upon rotation of the sleeve (84) in the first direction, the anchors (98) may move laterally through the first opening (130) in the housing (124) away from the sleeve (84) so that when the anchors (98) are engaged with the casing (78), and thus set, the anchors (98) are outside the housing (124).

Further, the housing (124) has an inner surface (132) and an outer surface (134). The inner surface (132) of the housing (124) includes at least one keyway (136), being an elongated convex protrusion on the inner surface (132) of the housing (124) extending into the bore of the housing (124). The keyway (136) extends from approximately the uppermost end of travel of the upper wedge (94) on the top threads (114) at the upper end (90) of the sleeve (84) to the anchors (98) and is oriented parallel to the longitudinal axis of the sleeve (84).

The upper wedge (94) includes at least one slot (138) being an elongated groove or recess in an outer surface (140)

of the upper wedge (94) oriented parallel to the longitudinal axis of the upper wedge (94), which is complementary to the keyway (136) of the housing (124). When the upper wedge (94) is mounted about the sleeve (84) within the housing (124), the keyway (136) is received within the slot (138). As a result, upon the rotation of the sleeve (84), the keyway (136) engages the slot (138) and prevents the rotation of the upper wedge (94) relative to the housing (124) in order that the upper wedge (94) may move along the sleeve (84) towards or away from the anchors (98). Although this means of preventing the rotation of the upper wedge (94) is preferred, other means which similarly prevent the rotation of the upper wedge (94) upon the rotation of the sleeve (84) may be used.

The housing (124) is inhibited from rotating relative to the wall of the wellbore (24) by at least one drag spring (142) mounted on the outer surface (134) of the housing (124). Preferably three drag springs are used. In the preferred embodiment, the three drag springs (142) each have a first end (144) mounted on the outer surface (134) of the housing (124) at the upper end (126) of the housing (124) by screws (146). The three drag springs (142) are equally spaced about the outer surface (134) of the housing (124). In addition, in the preferred embodiment the first end (144) of each of the drag springs (142) is recessed into the housing (124) so that the screws (146) are flush with the outer surface (134) of the housing (124). A second free end (148) of each drag spring (142) extends towards the lower end (128) of the housing (124) and each drag spring (142) has a surface (145) for contacting the casing (78) to inhibit rotation of the housing (124) in the wellbore (24).

Figure 11:
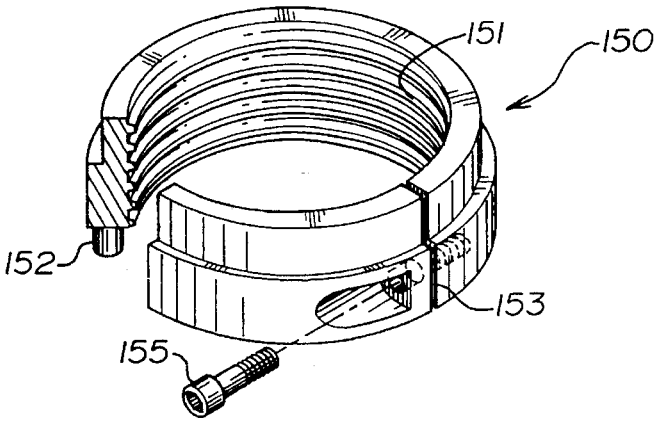
FIG. 11 is a pictorial view of the lock nut and clamping screw of the drilling tool of FIG. 1.

Once the upper wedge (94) is mounted about the upper end (90) of the sleeve (84) within the housing (124), a tubular lock nut (150) as depicted in FIG. 11 is mounted adjacent the upper wedge (94) at the upper end (90) of the sleeve (84) by a threaded inner surface (151) which enables the lock nut (150) to be screwed onto the top threads (114) on the sleeve (84). The lock nut (150) prevents the upper wedge (94) from moving nearer the upper end (90) of the sleeve (84) such that the inner surface (116) of the upper wedge (94) is disengaged from the top threads (114) on the outer surface (88) of the sleeve (84). The lock nut (150) includes a tab (152) facing the upper wedge (94). As well, the upper wedge (94) includes a tab (156) facing the lock nut (150). When the upper wedge (94) contacts the lock nut (150), the tabs (152, 156) meet and prevent further movement of the upper wedge (94). As a result, the housing (124) will rotate upon the further rotation of the sleeve (84) in the second direction. As well, the tabs (152, 156) inhibit the upper wedge (94) from binding against the lock nut (150). The lock nut (150) further includes a saw cut (153) and a clamping screw (155) which is tightened when the lock nut (150) is mounted on the sleeve (84) to provide for more firm contact between the lock nut (150) and the sleeve (84).

Figure 10:
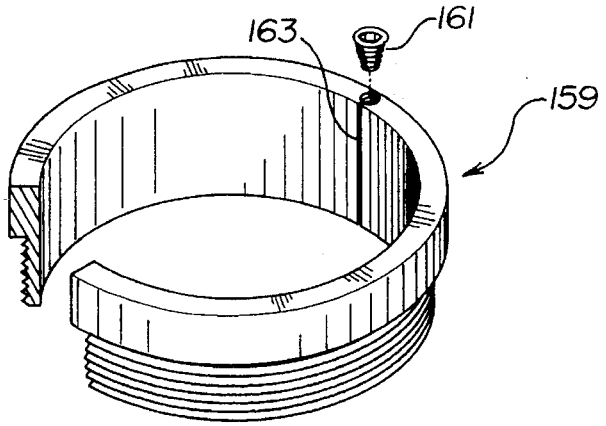
FIG. 10 is a pictorial view of the cap screw and wedge screw of the drilling tool of FIG. 1.

Finally, a tubular cap screw (159) as depicted in FIG. 10 is mounted within the inner surface (132) of the housing (124) by a threaded connection at its uppermost end (126). The cap screw (159) includes a wedge screw (161) which is screwed into the cap screw (159) at a saw cut (163) to spread the cap screw (159) and thus tighten the cap screw (159) in place within the housing (124).

Referring to FIGS. 5, 6 and 14, the housing (124) defines second elongate openings (164) at its lower end (128) which are oriented parallel to the longitudinal axis of the housing (124). Once the lower wedge (96) is mounted about the lower end (92) of the sleeve (84) within the housing (124), stop screws (160) are passed through the second openings (164) and are screwed into threaded holes (165) in the lower wedge (96) to mount them to the outer surface (162). As the sleeve (84) is rotated, the abutment of the stop screws (160) against the housing (124) prevents the rotation of the lower wedge (96) in order that the lower wedge (96) may move along the sleeve (84) towards and away from the anchors (98). As the lower wedge (96) is moved along the sleeve (84), the stop screws (160) slide within the second openings (164). Although this means of preventing the rotation of the lower wedge (96) is preferred, other means which similarly prevent the rotation of the lower wedge (96) upon the rotation of the sleeve (84) may be used.

All of the parts of the anchor assembly (82) except for the housing (124), the drag springs (142) and the springs (112) connected to the anchors (98) are preferably made from 4140 heat treated, stress relieved, high tension steel.

The tool (20) is further comprised of three means: means for actuating the anchor assembly (82) to selectively set and unset the anchors (98) and the anchor assembly (82); means for maintaining the orientation of the drill bit (30) in the desired direction during drilling of the well (22) when the anchor assembly (82) is set; and means for facilitating the orientation of the drill bit (30) prior to drilling. In the preferred embodiment, the setting means and the maintaining means both are located on the tubular member (68) and are capable of engaging the tubular member (68) with the sleeve (84) of the anchor assembly (82). As a result, upon the rotation of the drill string (26) in the first direction when the setting means are engaging the anchor assembly (82), the tubular member (68) rotates the sleeve (84) in order to set the anchors (98) in engagement with the casing (78) prior to drilling. In addition, upon the engagement of the maintaining means with the sleeve (84) once the anchor assembly (82) is set, further rotation of the drill string (26) in the first direction as a result of the reactive torque generated by the downhole motor (32) is inhibited. Further, in the preferred embodiment, the facilitating means are also located on the tubular member (68) and allow the tubular member (68) to rotate freely within the sleeve (84). As a result, when the facilitating means are actuated rotation of the drill string (26) rotates the attached drill bit (30) in order that the drill bit (30) may be oriented in the desired direction prior to drilling. Although the setting means and the maintaining means may be the same means, in the preferred embodiment, they are comprised of separate or different means as described below.

Referring to FIG. 1, in the preferred embodiment, the setting means, maintaining means and facilitating means are all comprised of different sections or portions of the tubular member (68), being a setting section (172), a working section (174) and a freewheel section (176). Preferably, the tubular member (68) is made from one length of pipe. In addition, the tubular member (68) preferably has a material strength of grade G105 or stronger in order to prevent the tubular member (68) from bending excessively when weight is applied to the drill bit (30).

The working section (174) is located adjacent to the upper end (76) of the tubular member (68). During drilling of the well (22), the working section (174) moves longitudinally through the anchor assembly (82) as the drill bit (30) is advanced through the wellbore (24). The length of the working section (174) should be chosen such that a reasonable distance can be drilled before the tool (20) must be repositioned in the wellbore (24), taking into account that the accuracy of the direction of the well will decrease as the length between the anchor assembly (82) and the drill bit (30) during drilling increases. Preferably, the length of the working section (174) is about 36 feet, to allow the drill bit (30) to be advanced up to about 36 feet during drilling of the well (22) before the tool (20) must be repositioned, thus facilitating the addition of one 30 foot length of drill pipe to the drill string (26) after each drilling cycle. If desired, the tubular member (68) can be designed to accommodate the addition of extensions to the working section (174).

Figure 3:
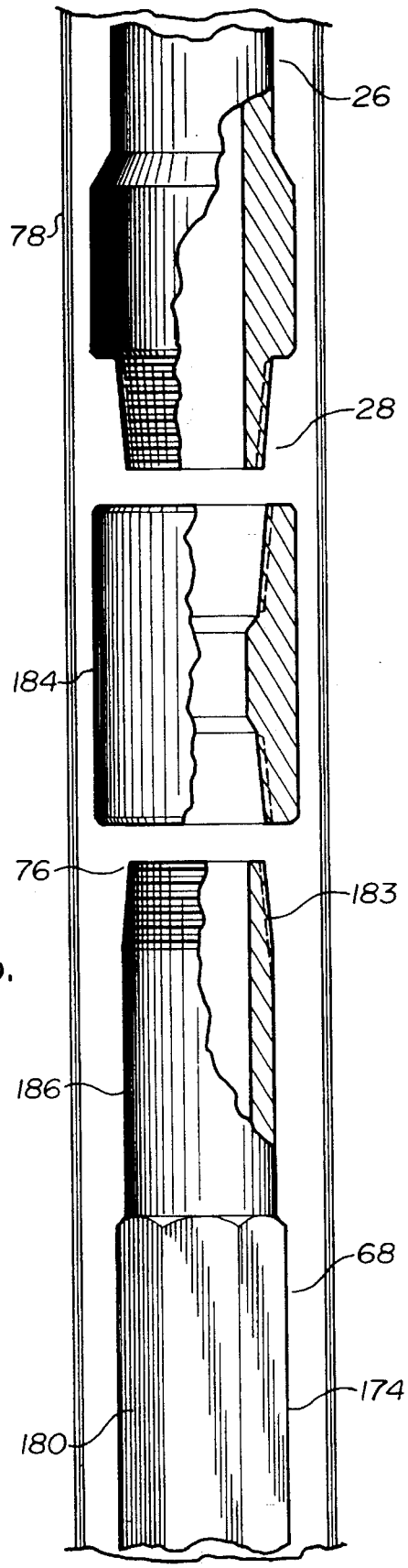
FIG. 3 is an exploded side view of the end of a drill string, a crossover sub, and the upper end of the tubular member of the drilling tool of FIG. 1.

In the preferred embodiment, the bore of the tubular member (68) preferably has an inside diameter of about 2 inches to allow wireline tools, including the survey tool (62), to pass through it freely. As well, in the preferred embodiment, and referring to FIG. 3, the upper end (76) of the tubular member (68) includes 2⅜ inch EUE threads (183). These threads (183) are threaded into one end of a double box crossover sub (184), as shown in FIG. 1. The other end of the crossover sub (184) also contains threads for receiving the end (28) of the drill string (26). Thus the crossover sub (184) connects the tubular member (68) to the drill string (26). The threads (183) are designed to be the weakest point in the tubular member (68). Thus, if excessive force is applied through the tubular member (68), the tubular member (68) will break at the threads (183) rather than another point in the tubular member (68), and the anchor assembly (82) will remain on the tubular member (68). Referring to FIG. 6, adjacent the threads (183) at the upper end (76) of the tubular member (68), between the threads (183) and the working section (174), the tubular member (68) includes an area (186) which has a smooth outer surface. This area (186) is preferably about one foot in length and is provided so that the threads (183) may be recut if any damage occurs to the threads (183) during drilling or while maintenance is performed on the tool (20).

In the preferred embodiment, the setting section (172) is located adjacent to the lower end (74) of the tubular member (68). The setting section (172) is preferably about 2.5 feet in length.

In the preferred embodiment, the freewheel section (176) is located between the setting section (172) and the working section (174) and has an outer surface (182) which is round and smooth to be freely rotatable within the inner surface of the sleeve (84). Preferably, the freewheel section (176) is about 3 feet in length.

The outer surface (178) of the setting section (172) and the outer surface (180) of the working section (174) are both complementary to the inner surface (86) of the sleeve (84) for engagement therewith. Consequently, the tool (20) could be designed so that the tubular member (68) comprises only two separate sections, a freewheel section (176) and a combined setting and working section. In the preferred embodiment, the outer surfaces (178, 180) are octagonal in shape or 8-sided. The setting and the working sections (172, 174) preferably have an outside diameter of about 2¾ inches when measured from the flat surface of one side to the flat surface of the opposite side and about 3 inches when measured from a corner to an opposite corner. The complementary inner surface (86) of the sleeve (84) is also 8-sided and has an inside diameter approximately 1/16 of an inch larger than the outside diameter of the setting and the working sections (172, 174) to allow the tubular member (68) to move longitudinally through the sleeve (84).

Although eight sides are preferred, a greater or smaller number may be used. A greater number of sides will allow the orientation of the drill bit (30) to be more finely adjusted in the desired direction as the working section (174) is moved into the sleeve (84). However, as the number of sides increases, the strength of the engagement between the sleeve (84) and the working or setting sections (174, 172) decreases. Thus, a balance must be sought between the strength of the engagement and the desired accuracy of the orientation of the drill bit (30).

Further, instead of a number of sides, the outer surfaces (178, 180) of the setting section and the working section (172, 174) may include a plurality of elongate splines (not shown) oriented parallel to the longitudinal axis of the tubular member (68). These splines are engaged with complementary splines (not shown) on the inner surface (86) of the sleeve (84) oriented parallel to the longitudinal axis of the sleeve (84). As with the number of sides, the number of splines is chosen to achieve the desired balance between the strength of the engagement and the accuracy of the orientation of the drill bit (30). Other complementary surfaces on the working and setting sections (174, 172) and on the sleeve (84) could also be used, so long as they permit engagement of the working section (174) and the setting section (172) with the sleeve (84).

As stated, the tubular member (68) is movable longitudinally relative to the sleeve (84) between the upper end of the working section (174) and the lower end of the setting section (172). As a result, the setting section (172) is movable into the sleeve (84) for engagement therewith in order to set and unset the anchor assembly (82). The working section (174) is movable into the sleeve (84) for engagement therewith during drilling to support the tubular member (68) and inhibit rotation of the drill string (26) due to reactive torque. Finally, the freewheel section (176) is movable into the sleeve (84) to allow the drill bit (30) to be oriented in the desired direction prior to drilling.

Figure 4:
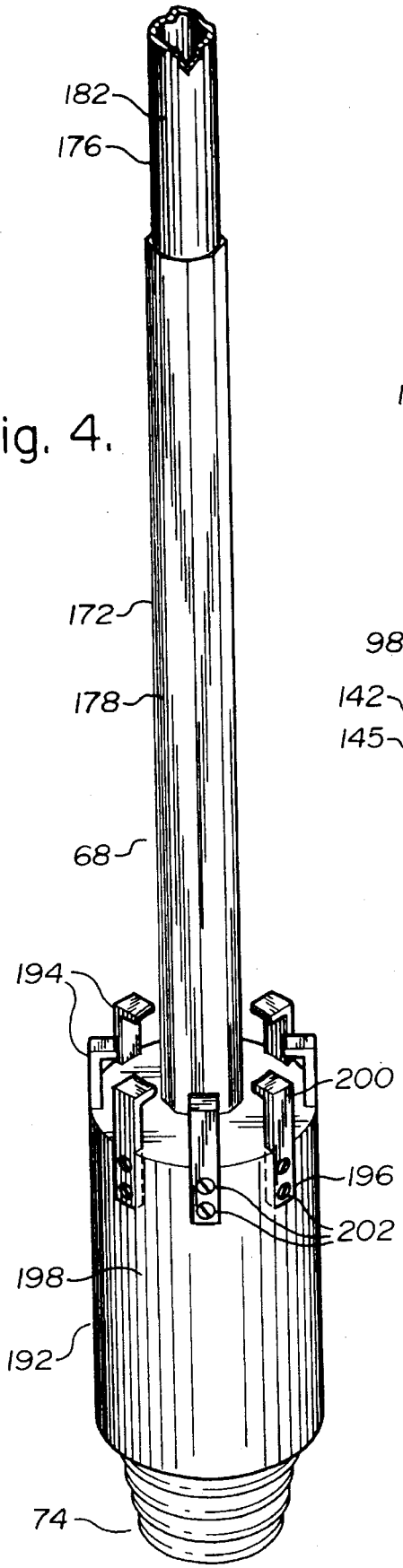
FIG. 4 is a pictorial view of the lower end of the tubular member and the lower joint of the drilling tool of FIG. 1.
Figure 16:
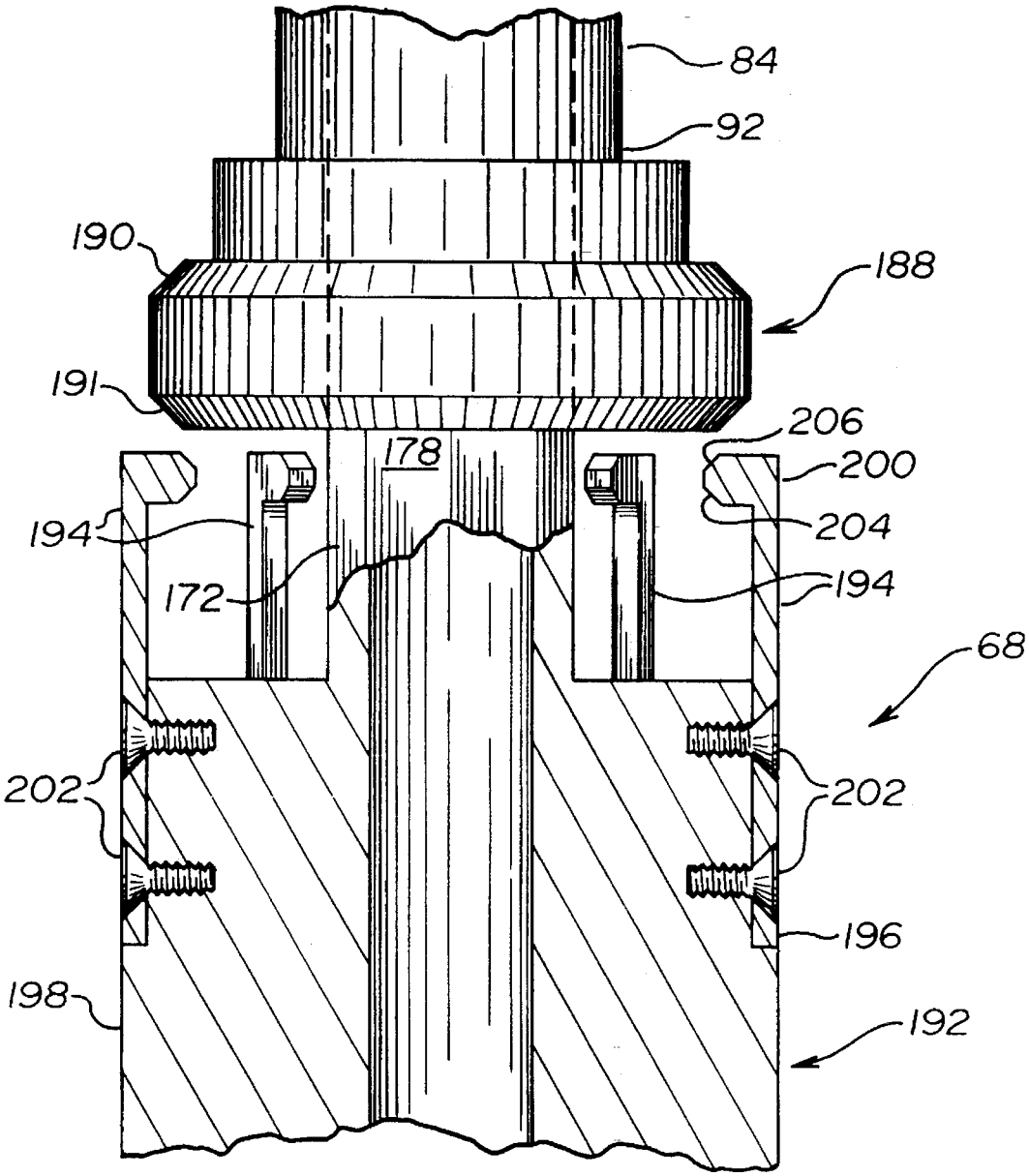
FIG. 16 is a pictorial side view of the latch member, lower joint and springs of the securing means of the drilling tool of FIG. 1, in the unlatched position.

Referring to FIGS. 4, 5 and 16, in the preferred embodiment, the tool (20) is also comprised of means for releasably securing the sleeve (84) in a latched position to the setting section (172) in order to prevent the longitudinal movement of the tubular member (68) relative to the sleeve (84) during positioning of the drill string (26) and the tool (20) in the wellbore (24) and during setting of the anchor assembly (82). In the latched position, as shown in FIG. 1, the setting section (172) is within the sleeve (84) and the securing means are operative as described further below.

The securing means are comprised of a tubular latch member (188) mounted on the lower end (92) of the sleeve (84) by a threaded connection. The latch member (188) includes an upper sloped latch shoulder (190) extending away from the sleeve (84) and facing towards the setting section (172), and a lower sloped latch shoulder (191) extending away from the sleeve (84) and facing towards the drill bit (30). As well, the securing means are comprised of the tubular member (68) including a tubular lower joint (192) mounted to the lower end (74) of the tubular member (68). The end of the lower joint (192) not mounted to the tubular member (68) is threadably connected to the upper end (72) of the drill pipe (66). The lower joint (192) is preferably about 2 feet in length to allow the threads connected to the upper end (72) of the drill pipe (66) to be recut if they are damaged in any way. A plurality of springs (194) are mounted to the end of the lower joint (192) adjacent the setting section (172). In the preferred embodiment, 8 springs (194) equally spaced about the lower joint (192) are used. Each spring (194) extends from a first end (196) mounted on an outer surface (198) of the lower joint (192) towards the setting section (172) to a second free end (200). Preferably the first end (196) of each spring (194) is recessed within the lower joint (192) so that the first end (196) is flush with the outer surface (198) of the lower joint (192). The first end (196) is preferably mounted to the lower joint (192) by screws (202) which pass through the first end (196) and into the lower joint (192).

The springs (194) are preferably about 1 inch in width, about 5 inches in length and between about ⅛ inch and ¼ inch in depth. The springs (194) provide for the screws (202) to be countersunk upon mounting of the springs (194) to the lower joint (192). The second end (200) of each spring (194) includes a lower sloped spring shoulder (204) facing towards the lower joint and an upper sloped spring shoulder (206) facing towards the sleeve (84). As a result, when the sleeve (84) is in the latched position, longitudinal movement of the sleeve (84) downward towards the drill bit (30) is prevented by the abutment of the latch member (188) against the lower joint (192). Longitudinal movement of the sleeve (84) upwards towards the freewheel section (176) is inhibited by the abutment of the upper latch shoulder (190) against the lower spring shoulder (204). The springs (194) are biased to maintain the sleeve (84) in the latched position until a downward longitudinal force is applied to the tubular member (68) which is sufficient to overcome the bias of the springs (194), causing the springs (194) to move outwards away from the sleeve (84). Thus, the sleeve (84) may move out of the latched position. The longitudinal force is applied to the tubular member (68) by applying weight on the drill string (26). To return the sleeve (84) to the latched position, the drill string (26) is pulled upwards until the lower latch shoulder (191) contacts the upper spring shoulder (206). Further upwards force causes the springs (194) to move outwards away from the sleeve (84) allowing the sleeve (84) to move to the latched position. Although these securing means are preferred, other securing means may be used.

Referring to FIGS. 1 and 2, the above described tool (20) is used to perform a method for drilling the deviated well (22) from the existing wellbore (24) through a gap such as a window (80) cut in the casing (78) of the wellbore (24). The window (80) is cut in the casing (78) using a whipstock (79) or other known apparatus for cutting a window in casing. The location of the window (80) helps define a point (208) in the wellbore (24) from which the deviated well (22) is to be drilled.

The first step in the method is positioning the drill string (26) and the attached tool (20) in the wellbore (24). While the tool (20) is being positioned, the sleeve (84) is in the latched position on the tubular member (68) to prevent longitudinal movement of the sleeve (84) relative to the tubular member (68). To position the drill string (26) and the tool (20), the drill string (26) is moved through the wellbore (24) until the drill bit (30) lies adjacent the window (80) and contacts the point (208) from where drilling is to commence. Once contact occurs, the drill string (26) is moved a distance away from the point (208) sufficient to allow the tubular member (68) to be moved through the sleeve (84) from the setting section (172) towards the working section (174) without contacting the drill bit (30) against the point (208) to be drilled until the working section (174) is located in the sleeve (84). According to the design of the preferred embodiment of the tubular member (68), this distance will be about 8 feet.

Once positioned, if the sleeve (84) is not in the latched position already, the tubular member (68) is moved longitudinally relative to the sleeve (84) so that the setting section (172) is located within the sleeve (84). Once in the latched position, the securing means described above maintain the setting section (172) in the sleeve (84). Further, the setting section (172) is engaged with the sleeve (84) such that the rotation of the tubular member (68) rotates the sleeve (84).

Next, the anchor assembly (82)is set in firm engagement with the casing (78). Setting of the anchor assembly (82) occurs by rotating the drill string (26) in the first direction, being to the left or counterclockwise. Rotation of the drill string (26) actuates the anchor assembly (82) by rotating the sleeve (84) in the first direction which causes the upper and the lower wedges (94, 96) to move together. As a result, the anchors (98) are moved laterally into contact with the casing (78). Approximately five complete rotations of the drill string (26) are required in the preferred embodiment to firmly engage the anchors (98) with the casing (78). When further rotation of the drill string (26) in the first direction is no longer possible, the anchors (98) and the anchor assembly (82) are set.

Setting of the anchor assembly (82) is then preferably confirmed by applying a longitudinal force on the drill string (26). Preferably, about 4,000 pounds are applied in an upward direction to confirm the setting of the anchor assembly (82).

The tubular member (68) is then moved longitudinally downwards relative to the anchor assembly (82) towards the commencement point (208) until the freewheel section (176) is located within the sleeve (84). The tubular member (68) is moved downwards by applying weight to the drill string (26). To allow this movement of the tubular member (68), the sleeve (84) must move out of the latched position. Therefore a sufficient weight must be applied to the drill string (26) to overcome the securing means, that is, to overcome the bias of the springs (112). As the tubular member (68) is lowered, the anchor assembly (82) maintains its position against the casing (78) in the wellbore (24). As a result of moving the freewheel section (176) into the sleeve (84), the tubular member (68) is disengaged from the sleeve (84) so that the tubular member (68) may freely rotate within the sleeve (84). By maintaining lefthand torque on the drill string (26) at the surface during lowering of the tubular member (68), the operator will know when the freewheel section (176) is in the sleeve (84) as rotation of the drill string (26) will be possible.

The survey tool (62) is then lowered into the orientating sub (44) in the manner previously described and the survey tool (62) surveys the orientation of the attached drill bit (30). Once the present orientation of the drill bit (30) is determined, the drill bit (30) is oriented in the desired direction by rotating the drill string (26). Rotation of the drill string (26) either clockwise or counterclockwise rotates the tubular member (68) within the sleeve (84) to position the drill bit (30) in the desired direction. The survey tool (62) is then removed from the orientating sub (44).

The tubular member (68) is then moved longitudinally downwards relative to the anchor assembly (82) towards the commencement point (208) until the working section (174) is at least partially located within the sleeve (84). To move the tubular member (68) in this manner, the drill string (26) may need to be rotated slightly either clockwise or counterclockwise to align the inner surface (86) of the sleeve (84) with the complementary outer surface (180) of the working section (174). Once in position, the working section (174) engages the sleeve (84) to inhibit the rotation of the tubular member (68) in the first direction and thus maintain the desired direction of the drill bit (30).

The deviated well (22) is then drilled by moving the drill string (26) and therefore the working section (174) longitudinally downwards in the sleeve (84) so that the drill bit (30) contacts the commencement point (208) while the downhole motor (32) rotates the drill bit (30) in the second direction. The drilling proceeds by applying weight on the drill bit (30) through the drill string (26) in order that the working section (174) moves through the sleeve (84) from a start position to an end position. In the start position, the end of the working section (174) adjacent the freewheel section (176) is in the sleeve (84). In the end position, the working position (174) has moved entirely downwards within the sleeve (84) such that no further longitudinal movement downwards is possible.

Once the entire length of the working section (174) has moved through the sleeve (84), the tubular member (68) is moved longitudinally upwards within the sleeve (84) in order that the setting section (172) is located within the sleeve (84) and the sleeve (84) is then moved into the latched position by applying sufficient weight to the drill string (26) to overcome the bias of the springs (112) to allow the sleeve (84) to be moved into the latched position. Once in the latched position, the securing means maintain the setting section (172) in the sleeve (84) in order to prevent the longitudinal movement of the tubular member (68) relative to the sleeve (84) during the subsequent unsetting of the anchor assembly (82).

The anchor assembly (82) is then unset from its engagement with the casing (78). Unsetting of the anchor assembly (82) occurs by rotating the drill string (26) in the second direction, being to the right or clockwise. Rotation of the drill string (26) actuates the anchor assembly (82) by rotating the sleeve (84) in the second direction which causes the upper and lower wedges (94, 96) to move apart while the springs (112) urge the anchors (98) into contact with the outer surface (88) of the sleeve (84). An operator will know when the anchor assembly (82) is unset by attempting to pull upwards on the drill string (26).

A further piece of pipe is then added to the drill string (26) at the surface to allow the entire tool (20) to be lowered within the wellbore (24). Once the drill string (26) and the attached drilling tool (20) are repositioned in the wellbore (24), the steps outlined above can be repeated in order to drill the deviated well (22) further. The drill string (26) and the attached drilling tool (20) can be repositioned within the wellbore (24) repeatedly until the anchor assembly (82) is located at the window (80) in the casing (78). It is not recommended that the anchor assembly (82) pass through the window (80) in the casing (78) and into the deviated well (22), since the anchor assembly (82) may not be capable of providing firm engagement with the uncased deviated well (22), and may also be prone to sticking in the uncased deviated well (22). As a result, once the anchor assembly (82) reaches the window (80) in the casing (78), the tool (20) is replaced with a conventional directional drilling tool such as a measure while drilling (MWD) system to continue the drilling of the deviated well (22).

Finally, the drilling of the deviated well (22) may be interrupted before the end position of the working section (174) is reached. During these interruptions, the survey tool (62) is relowered into the orientating sub (44) and the orientation of the drill bit (30) is surveyed in order to confirm that the orientation of the drill bit (30) is maintained in the desired direction during drilling. This confirmation of the orientation of the drill bit (30) may be performed as desired in order to maintain close supervision over the actual direction of drilling.

The embodiments of the invention in which an exclusive privilege or property is claimed are defined as follows:

1. A method for use in commencing the drilling of a deviated well from a point in a wellbore, the wellbore including a casing within it and the point defining a gap in the casing, using a non-rotary drill string having an attached drilling tool comprised of a drill bit for drilling the well, a downhole motor operatively connected to the drill bit for rotating the drill bit to drill the well, a tubular member connected between the downhole motor and the drill string and an anchor assembly, slidably mounted on and selectively actuated by the rotation of the tubular member, for releasably engaging the casing, the method comprising the steps of:

(a) positioning the drill string and the drilling tool in the wellbore;

(b) first engaging the tubular member with the anchor assembly such that rotation of the tubular member actuates the anchor assembly;

(c) setting the anchor assembly by rotating the drill string in a first direction in order that the drill string rotates the tubular member which actuates the anchor assembly such that the anchor assembly firmly engages the casing;

(d) disengaging the tubular member from the anchor assembly such that the tubular member may freely rotate within the anchor assembly;

(e) orienting the drill bit in a desired direction by rotating the drill string in order that the tubular member rotates within the anchor assembly to position the drill bit in the desired direction;

(f) second engaging the tubular member with the anchor assembly to support the tubular member and to inhibit further rotation of the tubular member in the first direction and thus maintain the desired direction of the drill bit while allowing the tubular member to move longitudinally relative to the anchor assembly; and (g) drilling the well by moving the drill bit to the point and operating the downhole motor to rotate the drill bit in a second direction opposite to the first direction such that any reactive torque generated by the downhole motor urges the drill string and the tubular member to rotate in the first direction, while applying weight on the drill bit through the drill string in order that the tubular member moves longitudinally relative to the anchor assembly as the drill bit advances to drill the well from the point, so that the tubular member moves longitudinally relative to the anchor assembly from a start position to an end position in which the tubular member can no longer move longitudinally relative to the anchor assembly.

2. The method as claimed in claim 1 further comprising the steps following step (g) of:

(h) unsetting the anchor assembly by rotating the drill string in the second direction in order that the drill string rotates the tubular member which actuates the anchor assembly such that the anchor assembly disengages the casing; and (i) repositioning the drill string and the drilling tool in the wellbore and repeating steps (b) through (g).

3. The method as claimed in claim 2 further comprising the steps of securing the tubular member to the anchor assembly during step (a) and step (i) in order to prevent the longitudinal movement of the tubular member relative to the anchor assembly during positioning and repositioning of the drill string.

4. The method as claimed in claim 1 wherein the tubular member comprises a setting section engagable with the anchor assembly, a working section engagable with the anchor assembly and a freewheel section freely rotatable within the anchor assembly and wherein step (b) is comprised of moving the tubular member longitudinally relative to the anchor assembly such that the setting section engages the anchor assembly, step (d) is comprised of moving the tubular member longitudinally relative to the anchor assembly such that the freewheel section is located within the anchor assembly, and step (f) is comprised of moving the tubular member longitudinally relative to the anchor assembly such that the working section engages the anchor assembly.

5. The method as claimed in claim 4 wherein the working section of the tubular member is moved through the anchor assembly in step (g) from the start position at a first end of the working section to the end position at a second end of the working section.

6. The method as claimed in claim 1 further comprising the steps of interrupting step (g) before the end position is reached, performing steps (d) through (f) again to confirm that the orientation of the drill bit is maintained in the desired direction, and then resuming step (g).

7. The method as claimed in claim 6 further comprising the steps prior to step (e) of lowering a survey tool into the drilling tool and determining the orientation of the drill bit with the survey tool.

8. The method as claimed in claim 7 further comprising the step of removing the survey tool from the drilling tool following step (e).

9. The method as claimed in claim 1 further comprising the step of confirming the setting of the anchor assembly after step (c) by applying a longitudinal force to the drill string.

10. The method as claimed in claim 5 wherein step (a) is comprised of moving the drill string through the wellbore until the drill bit contacts the point in the wellbore from which the well is to be drilled and then moving the drill bit a distance away from the point such that the tubular member can be moved longitudinally through the anchor assembly when the anchor assembly is set without contacting the drill bit against the point until the working section is located within the anchor assembly.

11. A tool for connection to a non-rotary drill string for use in commencing the drilling of a deviated well from a point in a wellbore, the wellbore including a casing within it and the point defining a gap in the casing, the tool comprising:

(a) a drill bit for drilling the well;

(b) a downhole motor operatively connected to the drill bit for rotating the drill bit to drill the well;

(c) a tubular member connected between the downhole motor and the drill string such that rotation of the drill string will cause rotation of the tubular member and the drill bit;

(d) an anchor assembly slidably mounted about the tubular member such that the tubular member is movable longitudinally relative to the anchor assembly, which anchor assembly is actuated by the rotation of the drill string, for releasably engaging the casing and for maintaining the orientation of the drill bit during drilling of the well;

(e) means for actuating the anchor assembly to selectively set the anchor assembly in engagement with the casing upon the rotation of the drill string in a first direction and to selectively unset the anchor assembly from engagement with the casing upon the rotation of the drill string in a second direction;

(f) means for facilitating the orientation of the drill bit prior to drilling by rotation of the drill string so that the drill bit is oriented in a desired direction; and (g) means for maintaining the orientation of the drill bit in the desired direction during drilling of the well when the anchor assembly is set by inhibiting the rotation of the drill string in the first direction caused by reactive torque generated in the drill string by the rotation of the drill bit in a second direction opposite to the first direction.

12. The tool as claimed in claim 11 wherein the actuating means, the facilitating means and the maintaining means are all associated with the tubular member.

13. The tool as claimed in claim 12 wherein the actuating means and the maintaining means are comprised of the tubular member having an outer surface complementary to an inner surface of the anchor assembly for engagement therewith.

14. The tool as claimed in claim 11 wherein:

(a) the actuating means are comprised of the tubular member including a setting section having an outer surface and the anchor assembly having an inner surface complementary to the outer surface of the tubular member for engagement therewith, wherein the setting section is longitudinally movable to within the anchor assembly to set and unset the anchor assembly by rotation of the drill string;

(b) the maintaining means are comprised of the tubular member including a working section having an outer surface and the anchor assembly having an inner surface complementary to the outer surface of the tubular member for engagement therewith, wherein the working section is longitudinally movable to within the anchor assembly and through the anchor assembly in order to advance the drill bit during drilling of the well while supporting the tubular member and inhibiting the rotation of the drill string; and (c) the facilitating means are comprised of the tubular member including a freewheel section having an outer surface freely rotatable within the inner surface of the anchor assembly, wherein the freewheel section is longitudinally movable to within the anchor assembly to allow the drill bit to be orientated in the desired direction prior to drilling of the well.

15. The tool as claimed in claim 14 wherein the setting section and the working section comprise the same section of the tubular member.

16. The tool as claimed in claim 14 wherein the setting section is adjacent a lower end of the tubular member to be located nearest the downhole motor, the working section is adjacent an upper end of the tubular member, and the freewheel section is between the setting section and the working section.

17. The tool as claimed in claim 14 wherein the outer surface of the setting section and the outer surface of the working section include a plurality of splines and the inner surface of the anchor assembly includes a plurality of complementary splines for engagement therewith.

18. The tool as claimed in claim 14 wherein the outer surface of the setting section and the outer surface of the working section and the inner surface of the anchor assembly are octagonal in shape.

19. The tool as claimed in claim 14, wherein the anchor assembly is comprised of:

(a) a sleeve slidably mounted on the tubular member for selectively engaging the setting section such that rotation of the tubular member rotates the sleeve and for selectively engaging the working section when the anchor assembly is set such that further rotation of the tubular member in the first direction is inhibited;

(b) an upper wedge having a first wedge surface movably mounted about an upper end of the sleeve;

(c) a lower wedge having a second wedge surface facing the first wedge surface movably mounted about a lower end of the sleeve;

(d) at least one anchor mounted about the sleeve between the first and second wedge surfaces, the anchor being movably laterally away from the sleeve for engagement with the casing;

(e) resilient means associated with the anchor for urging the anchor into close relationship with the sleeve; and (f) means for selectively moving the upper wedge and the lower wedge towards each other upon the rotation of the sleeve in the first direction such that the first and second wedge surfaces contact the anchor and move the anchor laterally for engagement with the casing, and for moving the upper wedge and the lower wedge away from each other upon rotation of the sleeve in the second direction such that the anchor moves laterally to disengage the casing.

20. The tool as claimed in claim 14 further comprising means for determining the orientation of the drill bit.

21. The tool as claimed in claim 14 wherein the length of the working section is about 36 feet, so that the drill bit can be advanced a maximum of about 36 feet during drilling of the well before repositioning the tool in the wellbore.

* * * * *